US005276484A

United States Patent [19]

Snelling

[11] Patent Number: 5,276,484

[45] Date of Patent: Jan. 4, 1994

[54] PIEZO-ACTIVE PHOTORECEPTORS AND SYSTEM APPLICATION

[75] Inventor: Christopher Snelling, Penfield, N.Y.

[73] Assignee: Xerox Corporation, Stamford, Conn.

[21] Appl. No.: 870,742

[22] Filed: Apr. 17, 1992

Related U.S. Application Data

[63] Continuation of Ser. No. 625,351, Dec. 11, 1990, abandoned.

[51] Int. Cl.[5] ..... G03G 5/00

[52] U.S. Cl. ..... 355/211; 430/56; 430/63

[58] Field of Search ..... 355/211, 212, 213; 346/158, 159; 430/56, 62, 63; 29/132; 310/311, 363, 364, 800

[56] References Cited

U.S. PATENT DOCUMENTS

| | | | |
|---|---|---|---|
| 4,377,629 | 3/1983 | Tarumi et al. | 430/62 |
| 4,392,178 | 7/1983 | Radice | 361/233 |
| 4,456,670 | 6/1984 | Nakayama et al. | 430/63 X |
| 4,529,292 | 7/1985 | Ohseto | 355/211 |
| 4,760,422 | 7/1988 | Seimiya et al. | 355/253 |

FOREIGN PATENT DOCUMENTS

| | | |
|---|---|---|
| 0080225 | 4/1988 | Japan . |
| 0033155 | 2/1990 | Japan . |

*Primary Examiner*—R. L. Moses
*Assistant Examiner*—Robert Beatty
*Attorney, Agent, or Firm*—Kenyon & Kenyon

[57] ABSTRACT

A piezo-active charge retentive member, such as a photoreceptor, has a grounded electrode layer separating a photoreceptive layer and a piezo-active layer. External vibration sources become unnecessary since supplying an A.C. voltage across the piezo-active layer to the grounded electrode layer causes the piezo-active layer, and thus the entire photoreceptor, to vibrate. Vibration of the photoreceptor enhances the transfer of development powder from the photoreceptor to the transfer material, such as a sheet of paper. Vibration of the photoreceptor also improves the development of images and assists the cleaning of residual development powder from the photoreceptor surface.

46 Claims, 3 Drawing Sheets

PIEZO-ACTIVE PHOTORECEPTORS AND SYSTEM APPLICATION

This application is a continuation of application Ser. No. 07/625,351, filed on Dec. 11, 1990, now abandoned.

BACKGROUND OF THE INVENTION

The present invention relates to an improvement in the transfer of particulate material from a photoreceptor element and the development and cleaning thereof, and in particular to a photoreceptor element comprising a piezoelectric component in an electrostatographic imaging device.

An example of an electrostatographic imaging device known in the art is described in U.S. Pat. No. 4,766,457 to Barker et al., assigned to the same assignee as the present application and is incorporated herein by reference. In such a device, developing powder, or toner, is transferred from a toner carrier to an electrostatographic image on a photoreceptor component. This developed image can then be transferred to paper or other printing material to form a more permanent representation of the electrostatographic image. Subsequently, the photoreceptor component is cleaned and the process can then be repeated.

In previous electrostatographic imaging devices, improved transfer from the toner carrier to the photoreceptor and from the photoreceptor to paper is achieved by agitating either the toner carrier or the photoreceptor. This agitation promotes the release of toner particles to the desired areas of development in the receptor.

As seen in U.S. Pat. No. 4,833,503, the development apparatus of a copying machine comprises a donor belt made of a piezoelectric polymer material. An external A.C. source supplies voltage to the belt through one of the rollers of the development apparatus. The net force of adhesion of toner to the belt is reduced through agitation of the piezoelectric belt surface. Therefore, an improved development of the final copy or print is achieved by the removal of more toner from the donor belt.

In U.S. Pat. No. 4,546,722, several methods for the removal of toner particles from the toner carrier are shown. In one method, a piezoelectric element is disposed in the carrier. An external A.C. source causes this piezoelectric element to vibrate, thus aiding in the release of toner from the carrier. In another method, the toner carrier is formed as a sheet having a piezoelectric layer. The carrier sheet is then securely clamped, and an A.C. source causes the entire sheet to vibrate having the results as mentioned above.

In U.S. Pat. No. 3,140,199, an external vibration mechanism is used to agitate the carrier belt. In U.S. Pat. No. 4,111,546, an external vibration mechanism is used to agitate the photoreceptor to remove toner residue. These vibration mechanisms can be acoustic or ultra-acoustic devices such as horns.

In U.S. Pat. No. 3,653,758, piezoelectric devices are coupled to the photoreceptor. If the photoreceptor is a plate, these piezoelectric devices can be disposed in a support structure for the photoreceptor. If the photoreceptor is a belt, these vibration devices can be placed in any of the rollers, around which the photoreceptor belt is moved.

In the previous methods mentioned above, external vibration devices or support structures agitate the photoreceptor or toner carrier. Space is provided in the copying system in order to incorporate these devices and support structures in the system. As the complexity of these copying systems increases, it becomes more difficult to provide space for these devices and support structures.

The systems described above under utilize space and lack cost efficiencies because of the need for external devices and support structures.

Furthermore, the quality of copy using such systems could be improved by transferring more toner during each stage of the copying process.

SUMMARY OF THE INVENTION

The deficiencies discuss above are overcome by the present invention. The charge retentive member of the invention described herein comprises a photoreceptive layer laminated on an electrode layer which in turn is laminated onto a piezo-active layer, the latter made at least in part of piezoelectric materials. In operation the electrode layer is coupled to ground as the laminate moves throughout the system.

The entire photoreceptor is vibrated by locating an A.C. corona device in close proximity to the photoreceptor. In an alternative embodiment, a conductive component such as a conductive roller is coupled to the photoreceptor, and an A.C. source supplies an alternating voltage across the piezo-active layer to ground. The alternating voltage across the piezo-active layer causes the entire photoreceptor to vibrate. Vibrations in the photoreceptor improve the transfer of toner in the development, transfer, and cleaning stages. The electrode layer prevents the A.C. source from interfering with electrostatographic imaging on the photoreceptor. The present invention also has applications in ionographic imaging devices and laminated substrates.

The above is a brief description of some deficiencies in disclosed electrostatographic imaging devices and advantages of the present invention. Other features, advantages and embodiments of the invention will be apparent to those skilled in the art from the following description, accompanying drawings and appended claims.

DETAILED DESCRIPTION

Figure 1:
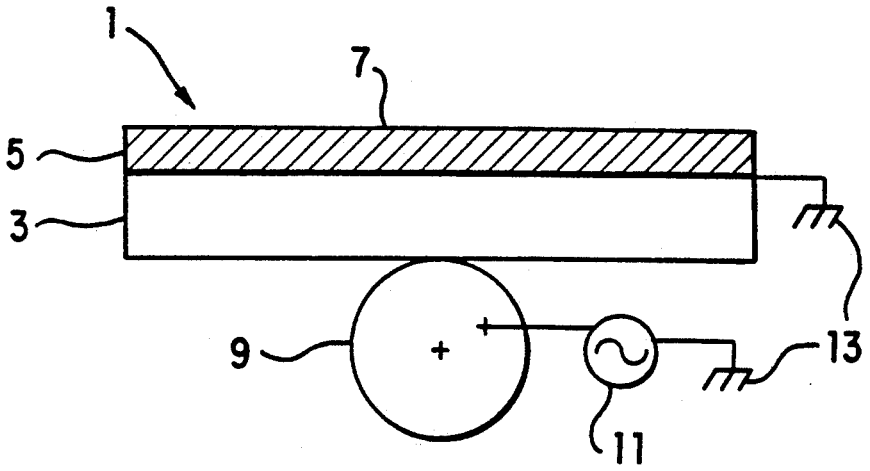
FIG. 1 is a schematic diagram of a section of a photoreceptor component constructed according to the present invention.

In the drawings, like reference numerals have been used throughout to designate identical elements. Referring to FIG. 1, a section of a charge retentive member, such as a photoreceptor component, of the present invention is shown. The photoreceptor component 1 has a structure that is similar to conventional organic photoreceptor components. The photoreceptor component 1 is a tiered, laminated structure comprising three layers:

a piezo-active layer 3, an electrode layer 5, and a photoreceptive layer 7.

The piezo-active layer 3 is made of a piezoelectric material such as, but not limited to, Polyvinylidine fluoride (PVDF), which is more commonly known by the trade name, Kynar ®. In previous photoreceptor components, a mechanical support layer is usually included to add rigidity to the photoreceptive layer. Similarly, the Kynar ® material of the piezo-active layer 3 gives the photoreceptor component 1 the rigidity needed for proper electrostatographic reproduction.

The electrode layer 5 is made of a conducting material such as, but not limited to, aluminum. The photoreceptive layer 7 can be amorphous selenium, or any of several other materials well known in the art for electrostatographic reproduction as taught, for example in U.S. Pat. No. 4,265,990 to Stokal. The electrode layer 5 is laminated between the piezo-active layer 3 and the photoreceptive layer 7. As an example, an aluminum electrode layer 5 can be formed on the piezo-active layer 3 (e.g. a sheet of Kynar ®) by vacuum deposition. Then, the photoreceptive layer 7 can be formed by evaporating amorphous selenium onto the aluminum electrode layer 5.

Figure 1A:
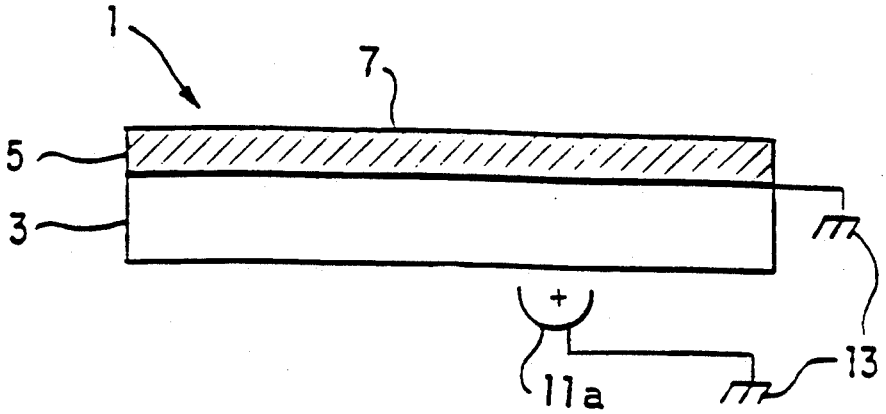
FIG. 1*a* is a schematic diagram of the photoreceptor component of FIG. 1 incorporating an A.C. corona device.
Figure 1B:
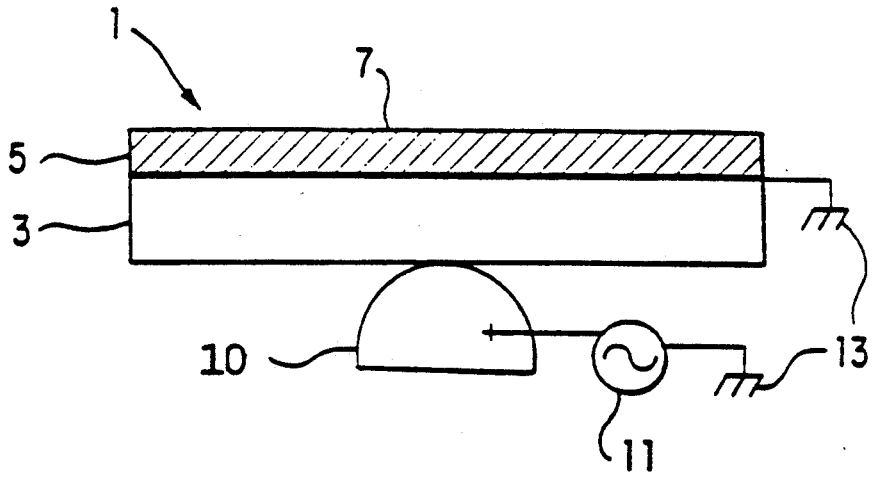
FIG. 1*b* is a schematic diagram of the photoreceptor component of FIG. 1 incorporating a shoe electrode.

The photoreceptor component is coupled to a conductive roller 9 such that the piezo-active layer 3 comes in contact with the conductive roller 9. An A.C. source 11 is coupled between a ground 13 and the conductive roller 9. In an exemplary embodiment, the A.C. source 11 supplies a sinusoidal voltage to the piezo-active layer 3 via the conductive roller 9. The sinusoidal voltage causes the piezo-active layer 3 and, thus, the entire photoreceptor component 1 to vibrate. It should also be noted that the magnitude of the sinusoidal electric field will be greatest, and thus the piezo-active layer 3 will have the largest deformation, in the area near the conductive roller 9. A wide variety of frequencies can be used for this sinusoidal voltage. The frequency of the sinusoidal voltage can be in the acoustic range, such as 20 KHz–60 KHz. The amplitude of the sinusoidal voltage is chosen depending on the thickness of the photoreceptor component 1, the piezoelectric properties of layer 3, and the desired magnitudes of acoustic motion. The electrode layer 5 is also coupled to ground 13. Therefore, the sinusoidal voltage from the A.C. source 11 flows through the piezo-active layer 3 to ground 13. Grounding the piezo-active layer 3 prevents the sinusoidal voltage from interfering with the operation of the photoreceptive layer 7. It should be noted that the conductive roller 9 can also be a shoe electrode and the photoreceptor component 1 can be dragged over this stationary electrode 10 (See FIG. 1*b*). Also, an A.C. corona 11*a* (See FIG. 1*a*) can be used instead of the conductive roller 9 and A.C. source 11 combination. An A.C. corona source supplies an alternating charge signal across the piezo-active layer 3 which also causes this layer to vibrate.

Figure 2:
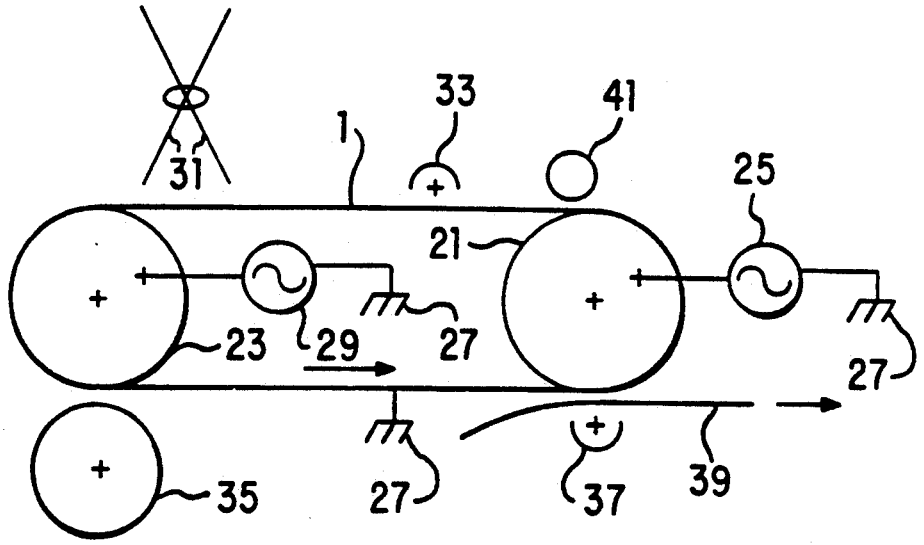
FIG. 2 is a schematic diagram of an electrostatographic reproducing system having a photoreceptor component constructed according to the present invention.

Referring to FIG. 2, an electrostatographic imaging device incorporating the piezo-active photoreceptor of the present invention is shown. In this embodiment, the photoreceptor component 1 is in the shape of a belt sleeved about a first conductive roller 21 and a second conductive roller 23. The photoreceptor component 1 moves around the conductive rollers 21 and 23 in the direction indicated by the arrow shown. A first A.C. source 25 is coupled between the first conductive roller 21 and a ground 27. A second A.C. source 29 is coupled between the second conductive roller 23 and ground 27.

As shown in the description of FIG. 1 above, the A.C. source supplies a sinusoidal voltage through the conductive rollers 21 and 23 to the piezo-active layer 3 (not shown in detail) of the photoreceptor component 1. The electrode layer 5 (not shown in detail) of the photoreceptor component 1 is coupled to ground 27 to prevent the sinusoidal voltage supplied by the A.C. sources 25 and 29 from interfering with the photoreceptive layer 7 (not shown in detail).

During a typical operation of an electrostatographic imaging device, the photoreceptive layer 7 of the photoreceptor component 1 is first charged to a uniform potential by a first corona charging device 33. The photoreceptive layer 7 is then exposed to a light image 31 of an original document or print characters. The light image 31 discharges the photoreceptive layer 7 in printable character or background areas. The remaining charge on the photoreceptive layer 7 forms a latent electrostatic image which corresponds to the original document or printed characters. The latent electrostatic image passes around the second conductive roller 23 to a development area.

A developer carrier 35 supplies toner particles to the photoreceptor component 1 in the development area. In standard electrostatic reproduction devices, the toner particles will have a charge opposite to that of the latent electrostatic image on the photoreceptor component 1. The second A.C. source 29 causes the photoreceptor component 1 to vibrate in the development area. This vibration is imparted to the developer carrier 35 which causes carrier bead bouncing on the photoreceptive surface 7. Thus, an increased number of carrier bead-toner to photoreceptor contact events occur as compared to previous electrostatographic imaging devices. This results in an enhanced development by improving development statistics.

The developed image on the photoreceptor component 1 then passes to a transfer area for transferring the developed toner to paper. In the transfer area, the photoreceptor component 1 comes in contact with the first conductive roller 21. A second corona charging device 37 is located near the first conductive roller 21. A sheet 39 made of a transfer material such as paper is transported between the second corona charging device 37 and the developed image on the photoreceptor component 1 in a known method. The second corona charging device 37 attracts the developed toner onto the sheet 39. The first A.C. source 25 causes the photoreceptor component 1 to vibrate in the transfer area. By vibrating the developed image on the photoreceptor component the net force of attraction holding toner particles to the photoreceptive layer 7 is reduced causing more toner particles to be drawn towards the second charge potential 37, and ultimately sheet 39. This transfer occurs as sheet 39 is transported through the transfer area in the direction of the arrow. The transferred toner is later permanently affixed to the sheet 39 by either the application of pressure, heat or any of other known methods.

Any residual toner still attached to the photoreceptor component 1 after passing the transfer area passes on to a cleaning area. The area on the photoreceptor component 1 that has attached residual toner remains in contact with the first conductive roller 21 when it passes to the cleaning area. A cleaning device 41 which can be, but not limited to, a brush comes in contact with the photoreceptor component 1 in the cleaning area. The first A.C. source causes the piezo-active layer 3 of the photoreceptor component 1 to vibrate. The combination of the cleaning device 41 and the vibration of the photoreceptor component 1 produces an improved removal of residual toner from the photoreceptor component 1 After the residual toner is removed from the photoreceptive layer 7, the photoreceptor component 1 is then prepared for exposure to light. The electrostatographic reproduction process described above repeats cyclically along a path as shown generally by an arrow.

There are many variations of the aforementioned embodiment. First of all, the photoreceptive layer 7 of FIG. 1 is not limited to inorganic compounds such as amorphous selenium, but includes organic materials that produce similar results. Also, the invention is not limited to belt-type photoreceptor components and may include plate or drum-type photoreceptor components as well.

The present invention has applications in ionography, which is well known in the art. A disclosed method of ionographic imaging is seen in United States patents U.S. Pat. No. 4,524,371 to Sheridan et al. and U.S. Pat. No. 4,463,363 to Gundlach, and in *Electrophotography* by R. M. Schaeffert, published by John Wiley & Sons, 1975 at pages 199–201, the disclosures of which are incorporated herein by reference in their entirety. In this electroradiographic process, an x-ray image is developed on an insulator plate. In standard ionographic processes, this plate usually comprises an insulator layer and a conductive layer. The plate can be modified by adding to the insulator sheet a piezo-active layer of a material such as PVDF (Kynar®). By modifying the ionographic plate in this manner, improved development, transfer, and cleaning can be achieved through vibration of the insulator plate as seen in the aforementioned photoreceptive process.

Similar improvements in electrostatographic processes can be obtained by adhering a piezo-active layer to an existing photoreceptor component. As mentioned in the description of FIG. 1, a standard photoreceptor component in electrostatographic processes comprises a layer of Mylar®, or similar material, for support. Rather than substituting a piezo-active layer for the Mylar® layer, a layer of piezo-active material can be adhered to the regular Mylar® layer, and thus, the entire photoreceptor component.

The above is a detailed description of a particular embodiment of the invention. The full scope of the invention is set out in the claims that follow and their equivalents. Accordingly, the claims and specification should not be construed to unduly narrow the full scope of protection to which the invention is entitled.

What is claimed:

1. A electrostatographic imaging device, comprising:

a photoreceptor including:

a photoreceptive layer arranged for movement along a closed path for recording an electrostatographic image, said photoreceptive layer having photoreceptive properties;

a piezo-active layer made of a piezoelectric material;

an electrode layer coupled between said photoreceptive layer and said piezo-active layer, said electrode layer made of an electrically conductive material; and a ground coupled to said electrode layer.

2. The device of claim 1, further comprising:

an alternating current corona source coupled to said ground in close proximity to said piezo-active layer, said alternating current corona source supplying an alternating charge signal across said piezo-active layer, said alternating charge signal causing vibration in said piezo-active layer.

3. The device of claim 2, further comprising:

a development powder carrier disposed in close proximity to said photoreceptive layer, said carrier providing development powder to said photoreceptive layer for developing said electrostatographic image.

4. The device of claim 2, further comprising:

a charge potential device located in close proximity to said photoreceptive layer, for effecting transfer of development powder on said photoreceptive layer toward said charge potential device.

5. The device of claim 2, further comprising:

a cleaning device located in close proximity to said photoreceptive layer, for removing development powder therefrom.

6. The device of claim 1, further comprising:

an alternating current voltage source coupled between said ground and said piezo-active layer, said alternating current voltage source supplying an alternating voltage signal across said piezo-active layer to said electrode layer and said ground for vibrating said piezo-active layer.

7. The device of claim 6, further comprising:

said photoreceptive layer being in the form of a belt, said belt being entrained about two rollers to define the path of movement for said belt;

an electrically conductive component coupled between said alternating current voltage source and said piezo-active layer.

8. The device of claim 7, wherein said electrically conductive component is at least one of said rollers.

9. The device of claim 7, wherein said conductive component is a shoe electrode.

10. The device of claim 7, further comprising:

a development powder carrier disposed in close proximity on one side of said belt and said conducting component being located in opposed relationship to said powder carrier on the other side of said belt, said carrier providing development powder to said photoreceptive layer for developing said electrostatographic image.

11. The device of claim 7, further comprising:

a charge potential device located in close proximity to said photoreceptive layer and said conductive component, such that development powder attached to said photoreceptive layer transfers from said photoreceptive layer towards said charge potential device.

12. The device of claim 7, further comprising:

a cleaning device located in close proximity to said conductive component for removing development powder from said photoreceptive layer.

13. An insulating sheet in an ionographic imaging apparatus, comprising:

an insulator layer for recording an electrostatographic image;

a conductive layer coupled to said insulator layer, said conductive layer made of a electrically conductive material;

an piezo-active layer coupled to said conductive layer, said piezo-active layer made of a material having piezoelectric properties; and a ground coupled to said conductive layer.

14. The device of claim 13, further comprising:

an alternating current corona source coupled to said ground in close proximity to said piezo-active layer, said alternating current corona source supplying an alternating charge signal across said piezo-active layer, said alternating charge signal causing vibration in said piezo-active layer.

15. The device of claim 14, further comprising:

a development powder carrier disposed in close proximity to said insulating sheet, said carrier providing development powder to said insulator sheet for developing said electrostatographic image.

16. The device of claim 14, further comprising:

a charge potential device located in close proximity to said insulator sheet, such that development powder attached to said insulator sheet transfers from said insulator sheet towards said charge potential device.

17. The device of claim 14, further comprising:

a cleaning device located in close proximity to said insulator sheet, said cleaning device coupled to said insulator sheet and said cleaning device removing development powder from said insulator sheet.

18. The device of claim 13, further comprising:

an alternating current voltage source coupled between said ground and said piezo-active layer, said alternating current voltage source supplying an alternating voltage signal across said piezo-active layer to said electrode layer and said ground, said alternating voltage signal causing vibration in said piezo-active layer.

19. The device of claim 18, further comprising:

a conductive component coupled between said alternating current voltage source and said piezo-active layer.

20. The device of claim 19, wherein said conductive component is a conductive roller.

21. The device of claim 19, wherein said conductive component is a shoe electrode.

22. The device of claim 19, further comprising:

a development powder carrier disposed in close proximity to said insulator sheet and said conducting component, said carrier providing development powder to said insulator sheet for developing said electrostatographic image.

23. The device of claim 19, further comprising:

a charge potential device located in close proximity to said insulator sheet and said conductive component, such that development powder attached to said insulator sheet transfers from said insulator sheet towards said charge potential device.

24. The device of claim 20, further comprising:

a cleaning device located in close proximity to said conductive component, said cleaning device coupled to said insulator sheet and said cleaning device removing development powder from said insulator sheet layer.

25. A electrostatographic imaging device, comprising:

a photoreceptor including:

a photoreceptive layer arranged for movement along a closed path for recording an electrostatographic image, said photoreceptive layer made from amorphous selenium;

a piezo-active layer made of polyvinylidine fluoride;

an electrode layer coupled between said photoreceptive layer and said piezo-active layer, said electrode layer made from aluminum; and a ground coupled to said electrode layer; and an alternating current voltage source coupled between said ground and said piezo-active layer, said alternating current voltage source supplying an alternating voltage signal across said piezo-active layer to said electrode layer and said ground for vibrating said piezo-active layer.

26. The device of claim 6 further comprising:

an electrically conductive component coupled between said alternating current voltage source and a limited area of said piezo-active layer, whereby vibration will occur in said limited area of said piezo-active layer close in proximity to said electrically conductive component.

27. The device of claim 26, wherein said electrically conductive component is a roller.

28. The device of claim 26, wherein said electrically conductive component is a shoe electrode.

29. The device of claim 18 further comprising:

an electrically conductive component coupled between said alternating current voltage source and a limited area of said piezo-active layer, whereby vibration will occur in said limited area of said piezo-active layer close in proximity to said electrically conductive component.

30. The device of claim 29, wherein said electrically conductive component is a roller.

31. The device of claim 29, wherein said electrically conductive component is a shoe electrode.

32. An electrostatographic imaging device, comprising:

a photoreceptor comprising:

a photoreceptive layer having photoreceptive properties arranged for movement along a closed path for recording an electrostatographic image;

a piezo-active layer made of a piezoelectric material;

an electrode layer coupled between said photoreceptive layer and said piezo-active layer, said electrode layer made of an electrically conductive material; and a ground coupled to said electrode layer;

a plurality of process areas located along said closed path of said photoreceptor;

means for vibrating at least one portion of said piezo-active layer in said photoreceptor, such that said photoreceptor is capable of being selectively vibrated in at least one of said process areas.

33. The device of claim 32, wherein said means for vibrating comprises an alternating current corona source coupled to said ground in close proximity to said piezo-active layer, said alternating corona source supplying an alternating charge signal across said piezo-active layer.

34. The device of claim 32, wherein said photoreceptor is in the form of a belt, said device further comprising at least two rollers, such that said photoreceptor is entrained around said rollers to define the path of movement for said belt, wherein said means for vibrating comprises an electrically conductive component coupled between said alternating current voltage source and said piezo-active layer.

35. The device of claim 34, wherein said electrically conductive component is at least one of said rollers.

36. The device of claim 34, wherein said conductive component is a shoe electrode.

37. The device of claim 32, wherein said plurality of process areas comprise:

a transfer area including a charge potential device located in close proximity to said photoreceptive layer, such that development powder attached to said photoreceptive layer transfers from said photoreceptive layer towards said charge potential device.

38. The device of claim 37, wherein said plurality of process areas further comprise:

a development area including a development powder carrier disposed in close proximity to said photoreceptive layer, said carrier providing development powder to said photoreceptive layer for developing said electrostatographic image.

39. The device of claim 38, wherein said plurality of process areas further comprise:

a cleaning area including a cleaning device coupled in close proximity to said conductive component for removing development powder from said photoreceptive layer.

40. The device of claim 32, wherein said plurality of process areas comprise:

a development area including a development powder carrier disposed in close proximity to said photoreceptive layer, said carrier providing development powder to said photoreceptive layer for developing said electrostatographic image.

41. The device of claim 40, wherein said plurality of process areas further comprise:

a cleaning area including a cleaning device coupled in close proximity to said conductive component for removing development powder from said photoreceptive layer.

42. The device of claim 32, wherein said plurality of process areas comprise:

a cleaning area including a cleaning device coupled in close proximity to said conductive component for removing development powder from said photoreceptive layer.

43. An electrostatographic imaging device for providing improved development through carrier bead bouncing, comprising:

a photoreceptor comprising:

a photoreceptive layer having photoconductive properties arranged for movement along a closed path on which an electrostatogrpahic image is recorded;

a piezo-active layer made of a piezoelectric material;

an electrode layer coupled between said photoreceptive layer and said piezo-active layer, said electrode layer made of an electrically conductive material; and a ground coupled to said electrode layer;

developing means disposed in close proximity to said photoreceptive layer, said developing means providing development powder to said photoreceptive layer for developing said electrostatographic images;

an alternating current voltage source coupled between said ground and said piezo-active layer, said alternating current voltage source supplying an alternating voltage signal across said piezo-active layer causing vibration in said piezo-active layer; and at least one electrically conductive component coupled between said alternating current voltage source and said piezo-active layer in close proximity to said development powder carrier such that vibration of said photoreceptor in close proximity to said development powder carrier causes carrier bead bouncing on a surface of said photoreceptor.

44. The device of claim 43, further comprising:

said photoreceptor being in the form of a belt, said belt being entrained about two rollers to define the path of movement for said belt, wherein said electrically conductive component is one of said rollers.

45. The device of claim 43, further comprising:

said photoreceptor being in the form of a belt, said belt being entrained about two rollers to define the path of movement for said belt, wherein said electrically conductive component is a shoe electrode.

46. An electrostatographic imaging device for providing improved development through carrier bead bouncing, comprising:

a photoreceptor comprising:

a photoreceptive layer having photoconductive properties arranged for movement along a closed path on which an electrostatographic image is recorded;

a piezo-active layer made of a piezoelectric material;

an electrode layer coupled between said photoreceptive layer and said piezo-active layer, said electrode layer made of an electrically conductive material; and a ground coupled to said electrode layer;

developing means disposed in close proximity to said photoreceptive layer, said developing means providing development powder to said photoreceptive layer for developing said electrostatographic images; and at least one alternating electric current corona source coupled between said ground and said piezo-active layer, said alternating current source supplying an alternating potential across said piezo-active layer causing vibration in said piezo-active layer, said alternating current corona source coupled in close proximity to said development powder carrier, such that vibration of said photoreceptor in close proximity to said development powder carrier cause carrier bead bouncing on a surface of said photoreceptor.

* * * * *

UNITED STATES PATENT AND TRADEMARK OFFICE

CERTIFICATE OF CORRECTION

PATENT NO. : 5,276,484

DATED : Jan. 4, 1994

INVENTOR(S) : Christopher Snelling

It is certified that error appears in the above-indentified patent and that said Letters Patent is hereby corrected as shown below:

| Column | Line | |
|---|---|---|
| 3 | 25 | After "component" insert --1--. |
| 3 | 50 | After "electrode" insert --10 (See FIG. 1b)--. |
| 3 | 52 | After "electrode" delete "10 (See FIG. 1b)". |

Signed and Sealed this

Fifth Day of July, 1994

Bruce Lehman

*Attest:*

BRUCE LEHMAN

*Attesting Officer*

*Commissioner of Patents and Trademarks*